United States Patent [19]

Takeuchi et al.

[11] Patent Number: 4,582,172

[45] Date of Patent: Apr. 15, 1986

[54] METHOD AND APPARATUS FOR AUTOMATICALLY GIVING AND RECEIVING ORDERS AND FOR MAKING CALCULATION THEREOF IN RESTAURANTS AND SHOPS

[75] Inventors: Tsutomu Takeuchi; Yo Kato, both of Matsudo; Shigeki Umezawa, Sakura, all of Japan

[73] Assignee: Kabushi Kaisha San Atomu, Chiba, Japan

[21] Appl. No.: 461,964

[22] Filed: Jan. 28, 1983

[30] Foreign Application Priority Data

Jan. 30, 1982 [JP] Japan ..... 57-13695

[51] Int. Cl.[4] ..... E04H 3/02

[52] U.S. Cl. ..... 186/38; 186/44

[58] Field of Search ..... 186/38, 39, 40, 41, 186/45–51; 364/464, 405

[56] References Cited

U.S. PATENT DOCUMENTS

| | | | |
|---|---|---|---|
| 565,180 | 8/1896 | Rucquoy | 186/46 X |
| 3,304,416 | 2/1967 | Wolf | 186/41 X |
| 4,415,065 | 11/1983 | Sandstedt | 186/39 |

FOREIGN PATENT DOCUMENTS

| | | | |
|---|---|---|---|
| 238343 | 2/1960 | Australia | 186/49 |

*Primary Examiner*—F. J. Bartuska

*Attorney, Agent, or Firm*—Toren, McGeady, Stanger, Goldberg & Kiel

[57] ABSTRACT

The method and apparatus of this invention can be used for smoothly giving and receiving orders between clients and cookers in restaurants and shops or the like so that clients can order the goods at their own discretion and calculation and also so that cookers can receive smoothly their orders and supply the made good to clients in turn of the received orders and make automatically calculation of the particulars and the total amount of the goods given by clients.

3 Claims, 9 Drawing Figures

METHOD AND APPARATUS FOR AUTOMATICALLY GIVING AND RECEIVING ORDERS AND FOR MAKING CALCULATION THEREOF IN RESTAURANTS AND SHOPS

BACKGROUND OF THE INVENTION:

This invention relates to a method and apparatus for automatically giving and receiving orders and for making calculation thereof in restaurants and shops, which on-line systematizes a series of works including from the giving and receiving of orders until the issue of calculation slips between the cookers' sections and the orderers' sections.

In restaurants such as "sushi" shops which carry on the face-to-face sales by making various kinds of goods to order, cookers used to calculate by heart the amount on hand for the received orders during making goods to rush orders from many orderers.

Under these circumstances, in the case when there occurred rush orders received from many orderers, cookers had to make and supply in turn the goods of orders received to the orderers to the best of their ability, and consequently the cookers as well as the orderers had sometimes doubts about accuracy of the calculation of the amount.

Further, in public restaurants, there exists the system such that waiters or porters receive orally orders from orderers, and hand over the slip on which they entered orders to cookers, so that sometime orderers cannot give orders by selecting with care the goods which meet budget and taste according to the manner of waiters.

SUMMARY OF THE INVENTION

This invention relates to a method and apparatus for smoothly giving and receiving orders between clients and cooker in restaurants and shops or the like by useing a microcomputer.

The object of the present invention is to provide a method and apparatus for automatically giving and receiving orders and for making calculation thereof in restaurants and shops, in which an order input unit for giving orders is provided in each of orderers' sections, said order input unit indicating good names and prices, a received order indicator and a giving and receiving of orders controlling and calculating device thereof are provided in each of cookers' sections, whereby a series of works including from the giving and receiving of orders until the issue of calculation slips are on-line systematized between the cookers' sections and the orderers' sections.

Another object of the present invention is to provide a method and apparatus for automatically giving and receiving orders and for making calculations thereof in restaurants and shops, in which an order input unit for giving orders is provided in each of orderers' sections, said order input unit indicating names and prices of goods, a received order indicator and a giving and receiving of orders controlling and calculating device thereof are provided in each of cookers' sections, whereby a series of works including from the giving and receiving of orders until the issue of calculation slips are on-line systematized between the cookers' sections and the orderers' sections.

DETAILED DESCRIPTION OF THE INVENTION

Figure 1:
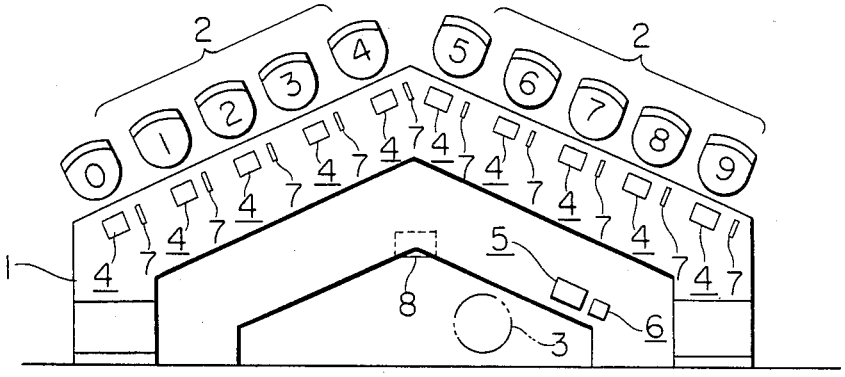
FIG. 1 is a plan view of the arrangement for the main portion of one embodiment.

Referring to the drawings, one embodiment of this invention will be explained in the following.

In FIG. 1, there is shown a plan view of the arrangement for the main portion of the embodiment for an automatic apparatus for giving and receiving orders and for making calculation thereof in "sushiya" restaurants according to this invention.

There are provided a predetermined number of seats 2 in the outside of the service counter 1 and also provided a cooker seat 3 in the inside thereof.

On the service counter 1 is provided the order input unit 4 at the position corresponding to each of the ten seats 2 from No. 0 to No. 9, said order input unit 4 indicating goods names and prices.

On the service counter 1 is provided the received order indicator 5 and the giving and receiving of orders controlling and calculating device 6.

The output produced from the order input unit 4 by touching of a light pen 7 provided on the service counter 1 at the position corresponding to every seat is inputted into a microcomputer 8.

Figure 2:
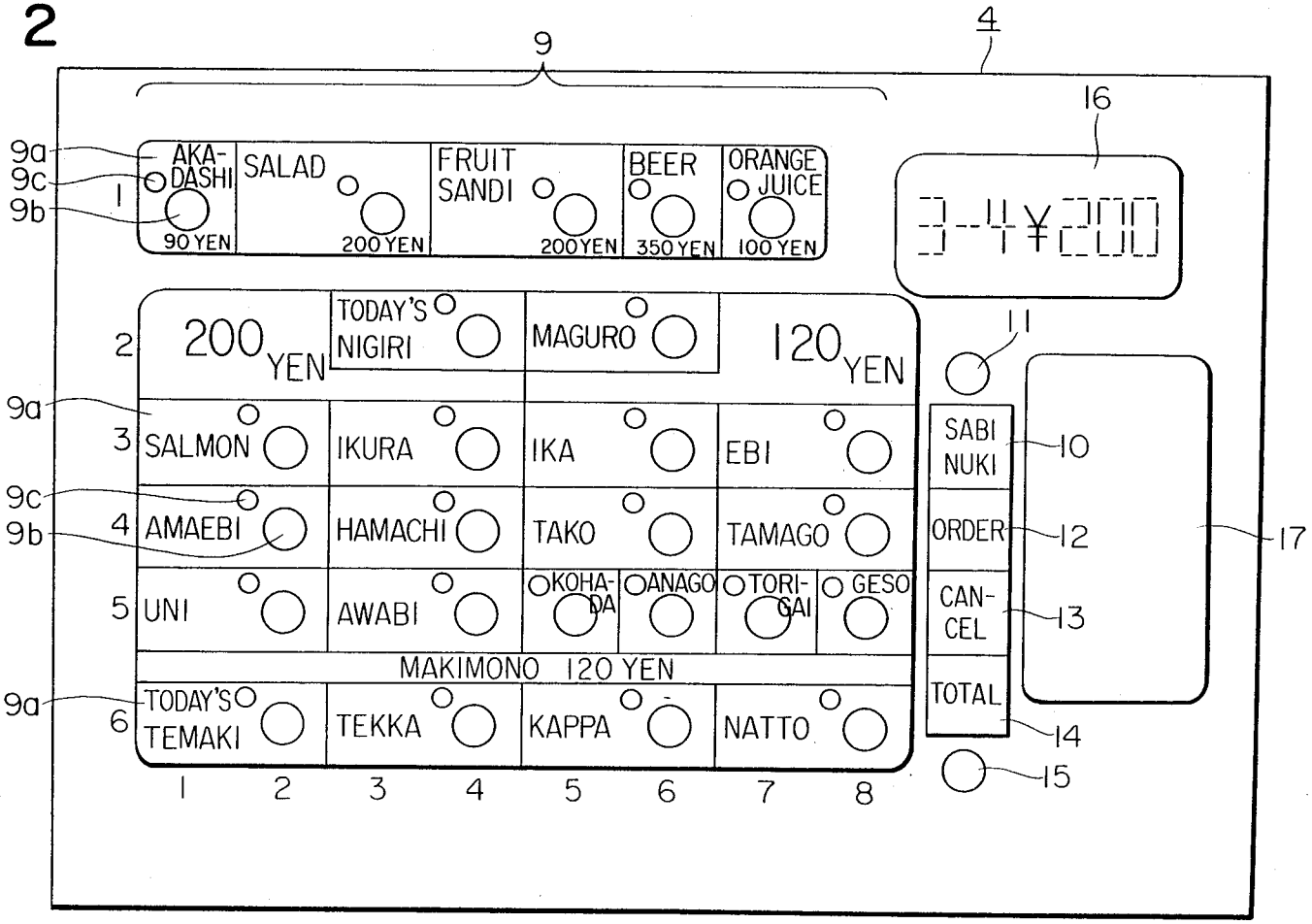
FIG. 2 is a plan view of one example for the display of the order input unit.

In FIG. 2, on the surface of the order input unit 4 is provided a goods name table 9 having a plurality of well regulated goods name sections **9*a***, each of which designates the names of goods and prices.

According to this embodiment, in said goods names sections **9*a*, the first lateral column designates names of drinks, salad and fruits, and the second to fifth lateral columns designate respectively names of hand-shaked "sushi", and at the upper left corner, there are indicated the prices per two pieces of the goods designated in the left half portion of said second to fifth lateral columns, and also at the upper right corner, there are indicated prices per two pieces of the goods designated in the right half portion of said second to fifth lateral columns. On the other hand, the sixth lateral column of the table 9** designate names of roll-shaped "sushi" and prices per piece.

Further, on the surface of said order input unit 4 are provided a non-"wasabi" instruction section 10, a non-"wasabi" instruction acknowledging a cancellation instructing section 13, lamp 11, an order instructing section 12, a total amount calculation instructing section 14, an operation acknowledging lamp 15, an order contents monitor 16, and a direction to handling 17.

In said goods name section **9*a*, there are indicated a circular mark 9*b* which shows the place to be touched by a light-pen 7, and also provided a lamp 9*c*** which acknowledges given orders by touching said light pen on said circular mark.

Figure 3:
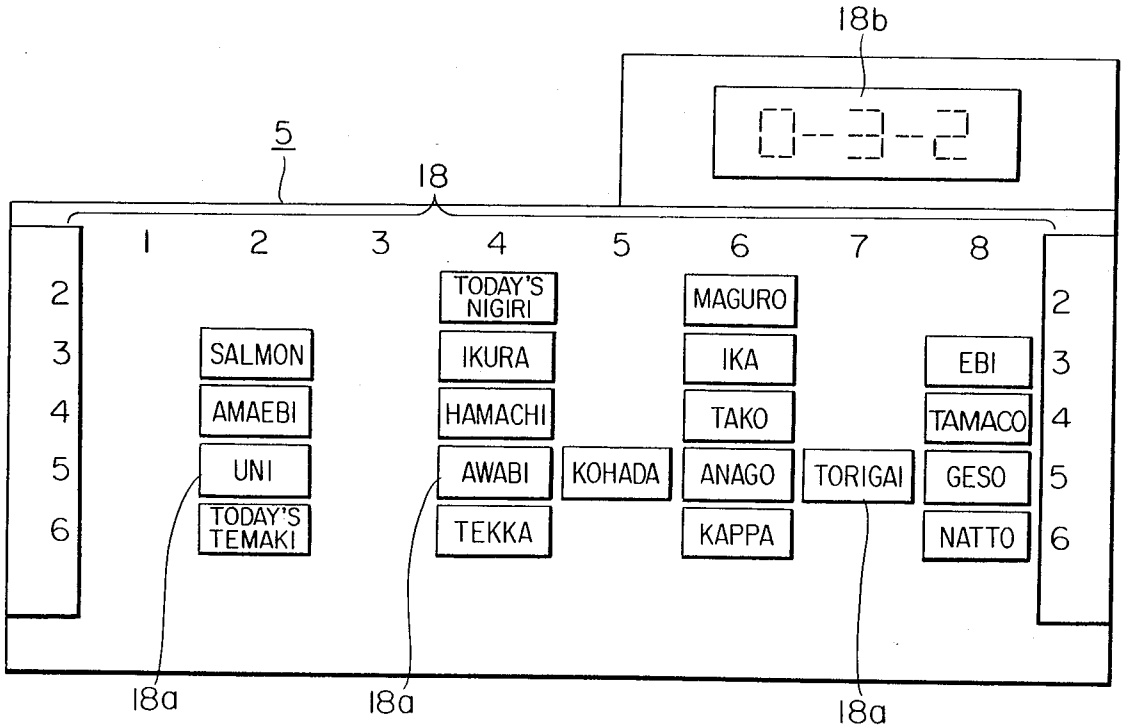
FIG. 3 is a plan view of the received order indicator.

As shown in FIG. 3, the received order indicator 5 is provided with a table 18 having a plurality of sections 18*a* which indicate by lighting the name of goods one by one in turn of orders received and with a digital indication section 18*b*.

In this embodiment, the Table 9 of the input unit 4 comprises six lateral columns and eight vertical columns and also the table 18 of the indicator 5 has the same structure as in the table 9 so that the goods name in the cross portions of the lateral column and the vertical column in the table 9 corresponds to the goods name in the cross portion of these columns in the table 18.

Figure 4:
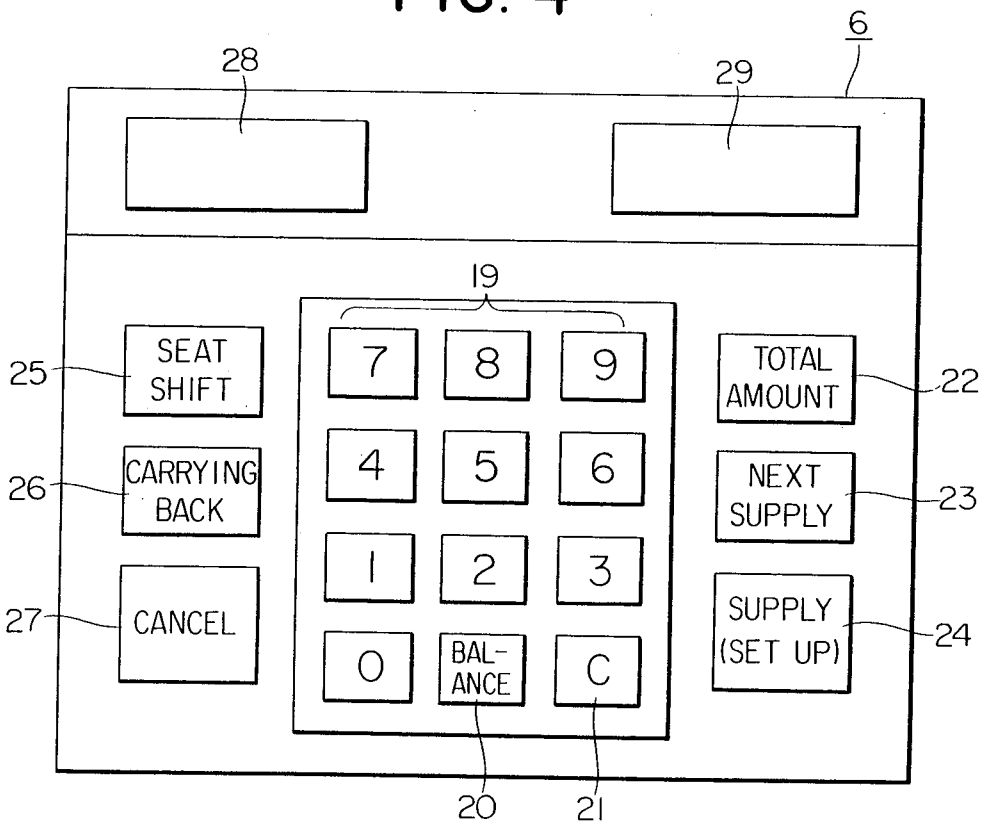
FIG. 4 is a plan view of the giving and receiving orders controlling and calculating device thereof.

As shown in FIG. 4, the device for control of the giving and receiving orders and for calculation 6 is provided with a seat number key 19, a received order balance key 20, a seat number clear key 21, a total amount calculation key 22, a next order confirmation key 23, a supply completion key 24, a seat shift key 25, a carrying back order key 26, an order cancellation key 27, a total amount calculation slip issuing printer 28, and in which said supply completion key 24 is also used for a price amendment key.

Figure 5:
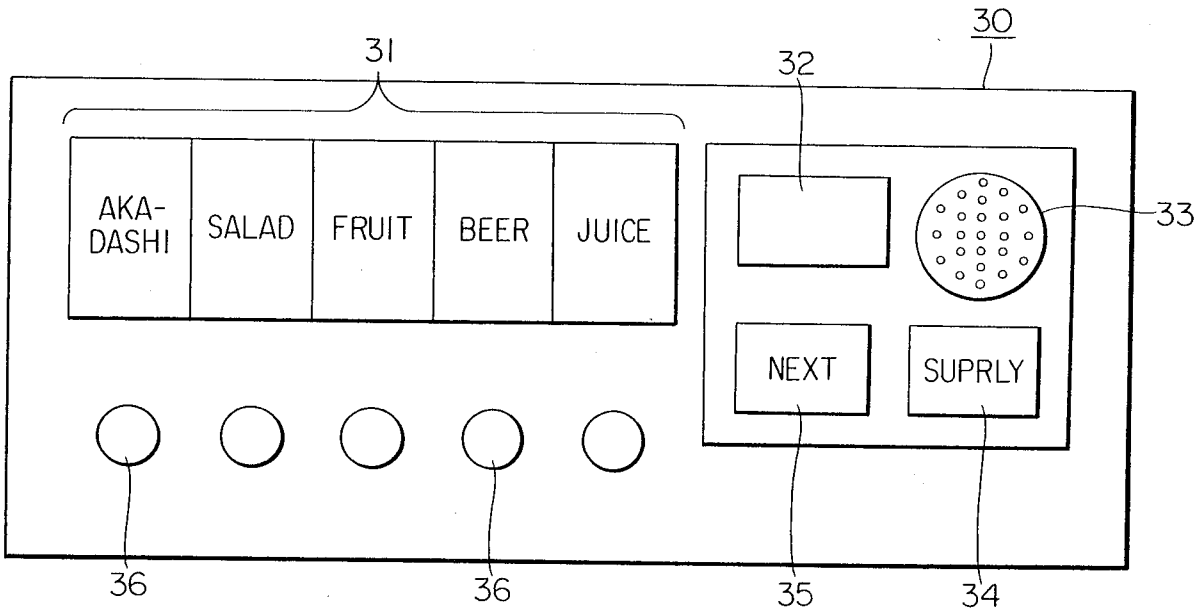
FIG. 5 is a plan view of the other indicator.

The order of the goods indicated in the first lateral column in the goods name section 9 of said order input unit 4 is shown in an indicator 30 in FIG. 5.

Said indicator 30 is provided with a goods names indicating section 31 which indicates the orders received by lighting and an orderer seat number indicating section 32 and also provided internally with a sound mechanism 33 such as orgel, chime, bell and silen which actuates by giving an order. And said indicator 30 is also provided with a supply key 34 which is pushed by the cooker when ordered goods are supplied to the orderers and a next order confirmation key 35. Further, a lamp 36 for indicating order received is provided below each of the goods name sections.

The actuation of the sound mechanism is stopped by pushing the supply key 34.

All of the signals from each of the order input unit 4, the received order indicator 5, the giving and receiving of orders controlling and calculating device 6 and the indicator 30 are memorized in the micro-computer 8 and outputted according to necessity.

Figure 6:
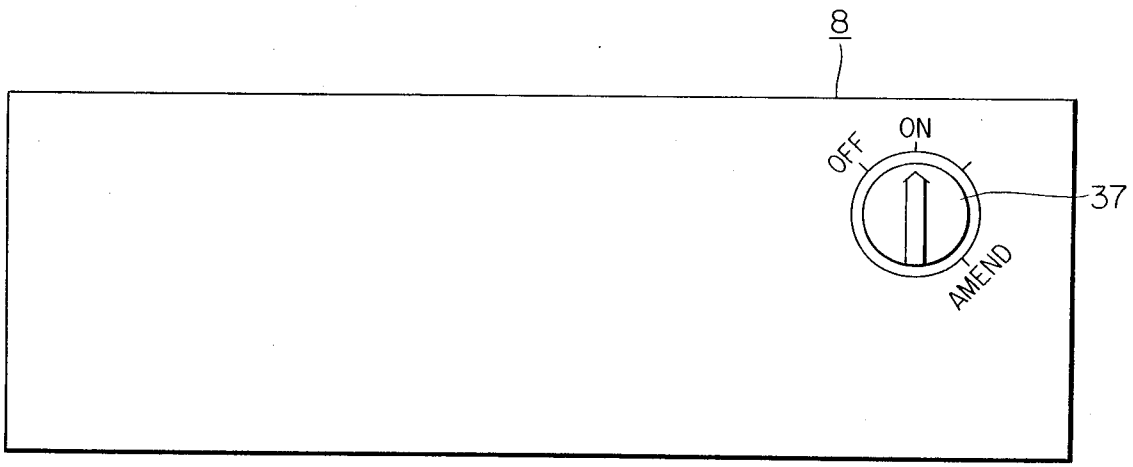
FIG. 6 is a front view of a microcomputer.

As shown in FIG. 6, the micro-computer 8 having a central processing unit (C. P. U.) is provided with an operation dial 37.

Figure 7:
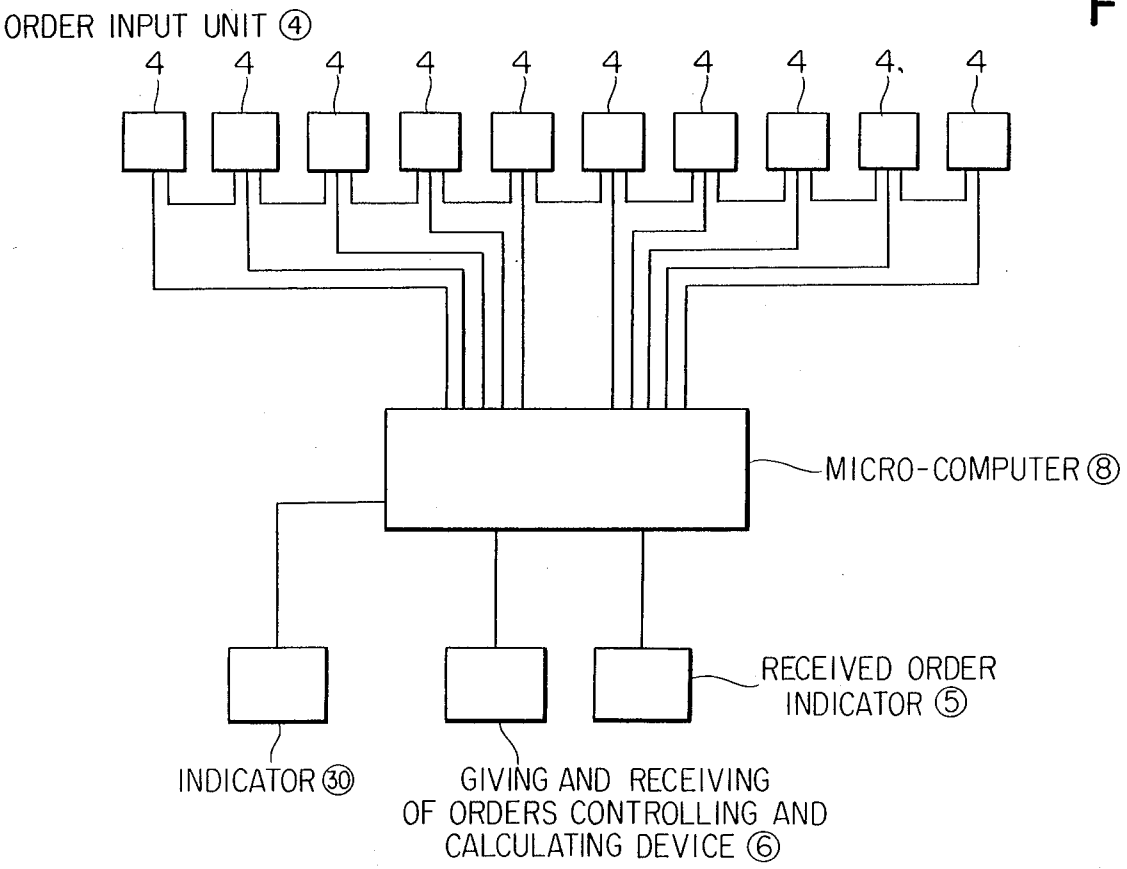
FIG. 7 is a block diagram of the present invention.

FIG. 7 shows block diagram of the present invention.

The apparatus of this invention as constituted above can be used as mentioned below. Firstly, when orderers take their seats 2, and find the operation confirmation lamp 15 of the order input unit 4 being lighted, they can commence their orders. In other words, by lighting of this operation confirmation lamp 15, the orderer in said seat can note that the order has become possible. Nextly, the orderer touches the order instruction section 12 of the order input unit 4 with light pen 7 and then touches the portion of the name of goods the orderer desires in the goods name table 9. By this operation, the portion which shows the ordered goods names in the received order indicator 5 at the cooker's section is lighted and flashed, and consequently the cooker can note the contents of the received order.

For example, when the orderer at the seat 3 orders a cuttlefish (IKA in Japanese) which is indicated in the crossing portion of the 3rd lateral column and the 4th vertical column on the goods names sections 9 of the order input unit 4, the indication of said cuttlefish in the cross portion of the 3rd lateral column and the 4th vertical column on the section 18 of the received order indicator 5 appears by lighting and flashing.

In this case, when the orderer asks for the non-"wasabi" instruction and touches with the light pen 7 to the non-"wasabi" instruction section 10, the number "0" is digitally indicated on the left side of the seat number of orderer of the section 18*b* of the received order indicator 5, by which the non-"wasabi" instruction is received by the cooker.

Then, when said number "0" is digitally indicated, the non-"wasabi" instruction acknowledging lamp 11 in the order input unit 4 is lighted by which the orderer can acknowledge the fact that his instruction for non-"wasabi" was received by the cooker.

Even when orders are given by other orderers, the indications in the sections 18, 18*b* are made in turn by the memory of the micro-computer 8, namely these indications are never made at the same time.

After the cooker acknowledges the fact that the orderer of the seat No. 3 has given the order of a cuttlefish with non-"wasabi" instruction, said cuttlefish being indicated in the crossing portion of the 3rd lateral column and the 4th vertical column on the goods name section 9, and then hands the prepared goods to the orderer of the seat No. 3, he pushes the supply completion key 24 of the giving and receiving of orders controlling and calculating device 6, by which the indications of the sections 18, 18*b* are cancelled and the contents of next order are indicated in said sections.

The digital number indicated on the right side of the seat number indication of the section 18*b* shows the number of the goods given in the same kind. When the indication of the sections 18, 18*b* are cancelled by pushing the supply completion key 22, the indication of the next order appears in the same sections.

However, when the new orderer asks for the non-"wasabi" instruction, the "0" number indication is cancelled. In the case that the order of cuttlefish in the crossing portion of the 3rd lateral column and the 4th vertical column on the goods name section 9 is not subsequently received, the "1" number indication on the right side of the seat number has remained as it is.

On the other hand, in the case that the cooker wants to confirm the subsequent orders during cooking, he can do it by means of pushing the next order confirmation key 23 of the giving and receiving of orders controlling and calculating device 6, by which the indication of goods names of the received orders appears in the section 18 and the number of the received orders appears on the right side of the section 18*b*.

Further, when the cooker notices the fact that the stock of the goods ordered by the orderer runs out and pushes the cancellation key 27, the indication of the name of said goods ordered by operating the order input unit 4 in the seat of orderer is cancelled, and at the same time the indication of the order contents monitor 16 is also cancelled. In such case, the orderer will give the order for another goods or terminate his eating and drinking.

When the eating and drinking are terminated, the amounts of costs of the goods supplied in each of the orderers' seats are added and memorized by the micro-computer 8. Accordingly, it is possible to issue the calculation slip on which the particulars of the costs are printed through the printer 25 simply by pushing the calculation key 22 and the seat number key 19. Consequently, the cooker can hand the slip to the orderer, and the orderer can pay the eating and drinking costs with the slip.

Figure 8:
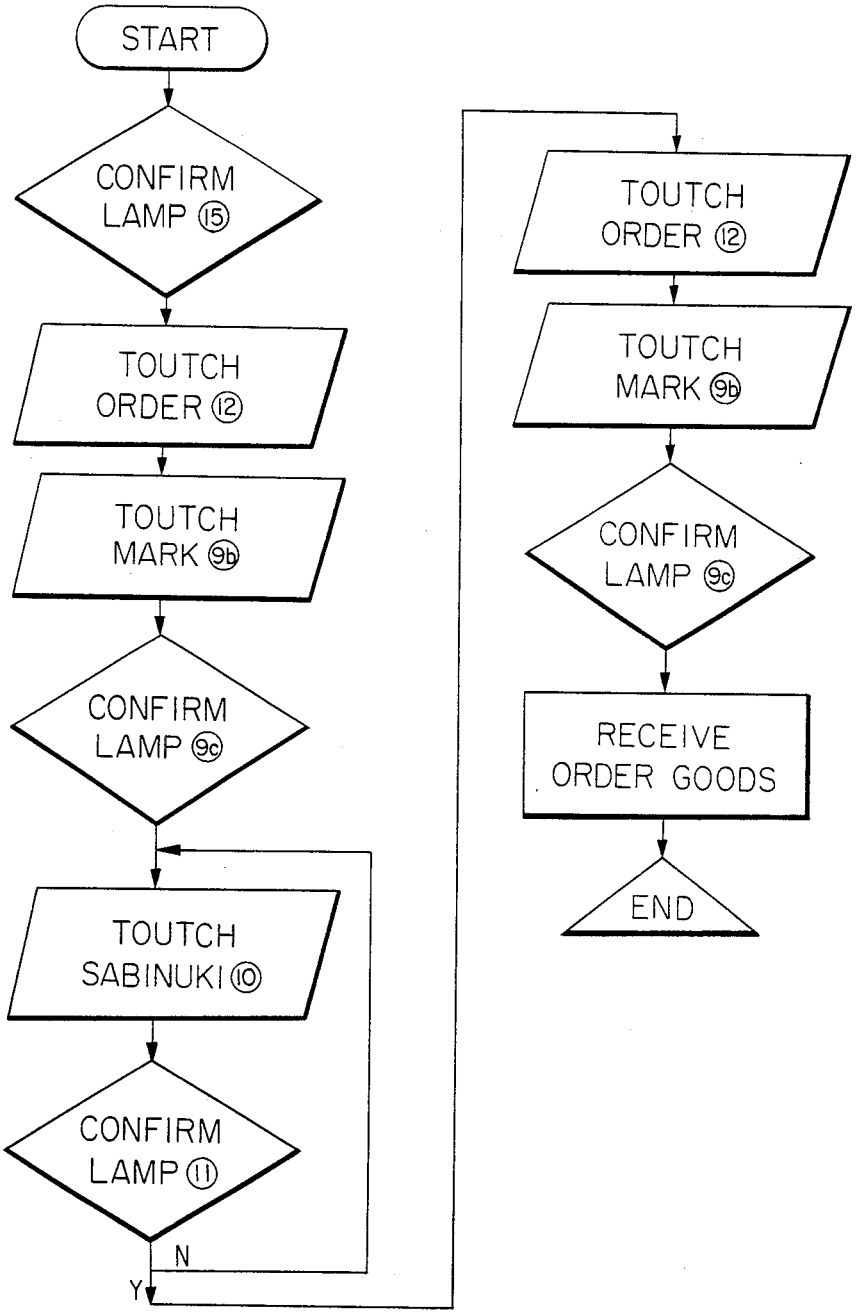
FIG. 8 is a flow chart showing the operation by order.
Figure 9:
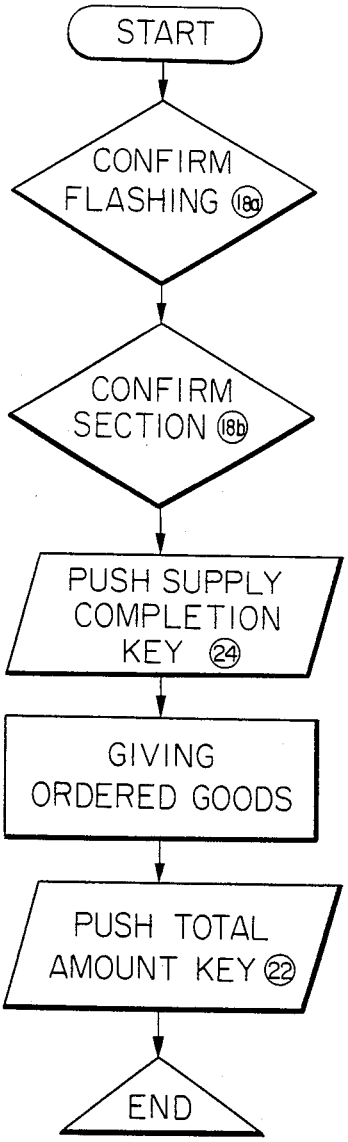
FIG. 9 is a flow chart showing the operation by cookers.

FIG. 8 is a flow chart showing the operations by orderers, and FIG. 9 is a flow chart showing the operations by cookers.

As will be noted clearly, according to the appartus of this invention in which a series of works including from the giving and receiving of orders until the issue of calculation slips are on-line systematized between the cookers' sections and the orderers' sections, there are excellent advantages such that the cookers do not need to calculate by heart the amounts of the received orders and that the orderers can give the orders confirming the amount on hand of the ordered goods.

What claimed is:

1. A method of automatically giving and receiving orders for food items and of calculating the prices of the food items ordered in a food service establishment such as a "sushi" shop and the like, comprising the steps of dividing one side of a service counter into a plurality of individual service sections with each service section arranged to accommodate a single diner, providing an electronically operated order input unit at each service section and providing means and prices of the food items to be ordered on the order input unit, selecting by the diner at each service section the food items ordered by inputting the selected food items in the order input unit, arranged a chef's section on the opposite side of the counter from the diner's service sections extending for a given number of individual adjacent service sections so that the chef has direct access across the service counter to each of the diners in the given number of individual service sections, locating an electronically operated indicator in the chef's section for receiving orders from the order input units in the service sections of the service counter and positioning a controlling and calculating device adjacent to the indicator, locating a micro-computer for storing the orders received from the order input units for supplying the orders to the indicator, selectively filling the orders by the chef from the information in the indicator and supplying the ordered food items to the diner, obtaining a check from the controlling and calculating device for the food items ordered and supplied to the diner, and presenting the check to the diner.

2. A method of automatically giving and receiving orders for food items and of calculating the prices of the food items ordered in a food service establishment such as a "sushi" shop and the like, comprising the steps of dividing one side of a service counter into a plurality of individual service sections with each service section arranged to accommodate a single dinner, providing an electronically operated order input unit at each service section and dividing the order input unit into a plurality of input sections with at least certain of the input sections listing names and prices of food items to be ordered, selecting by the diner at each service section the individual food items ordered by inputting the selected food items in the order input unit, arranging a chef's section on the opposite side of the counter from the diner's section extending for a given number of individual adjacent service sections so that the chef has direct access across the service counter to each of the diners in the given number of individual service sections, locating an electronically operated indicator indicating the individual food items ordered at a specific diner service section in the chef's section for receiving orders from the order input units in the service sections of the service counter and positioning a controlling and calculating device adjacent to the indicator, locating a micro-computer for storing the orders received from the order input units for supplying the orders to the indicator, selectively filling the orders by the chef from the information in the indicator and supplying the ordered food items to the diner, obtaining a check from the controlling and calculating device for the food items ordered and supplied to the diner, and presenting the check to the diner.

3. Apparatus for automatically entering individual orders for food items, for receiving the orders, and for calculating the price of the ordered goods, comprising an elongated service counter having an elongated first side and an opposite elongated second side, said first side of said service counter being divided into a number of adjacent service sections each arranged to accommodate a single diner, an electronically operated order input unit located at each service section, said order input unit divided into a plurality of input sections with at least certain of the input sections listing names and prices of the food items to be ordered, said second side of said service counter comprising a chef's section for a given number of individual adjacent service sections so that the chef can prepare food items at the chef's section and deliver the prepared food directly across the service counter to the diners in the given number of service sections, an electronically operated indicator at said chef's section for receiving orders from the given number of individual adjacent service sections, a controlling and calculating device at said chef's section in cooperation with said indicator whereby an order received in said indicator from an individual service section can be processed by the chef in the chef's section and served to the diner and said controlling and calculating device can issue a check for the cost of the ordered goods.

* * * * *